US005875252A

United States Patent [19]

Lesage

[11] Patent Number: 5,875,252

[45] Date of Patent: Feb. 23, 1999

[54] LOUDSPEAKER FOR HIGH FREQUENCIES

[75] Inventor: Philippe Lesage, Dammarie Les Lys, France

[73] Assignee: P.H.L. Audio, Chartrettes, France

[21] Appl. No.: 659,361

[22] Filed: Jun. 6, 1996

[30] Foreign Application Priority Data

Jun. 16, 1995 [FR] France ..... 95 07198

[51] Int. Cl.[6] ..... H04R 25/00

[52] U.S. Cl. ..... 381/156; 381/202

[58] Field of Search ..... 381/156, 192, 381/194, 199, 202; 181/152, 157, 159, 167, 177, 199

[56] References Cited

U.S. PATENT DOCUMENTS 2,058,208 10/1936 Blattner ..... 181/159
5,098,976 3/1992 Uryu et al. ..... 381/202
5,150,419 9/1992 Kizak et al. ..... 381/194

FOREIGN PATENT DOCUMENTS 0082086 6/1983 European Pat. Off. .
0336448 10/1989 European Pat. Off. .
0480160 4/1992 European Pat. Off. .
400343 10/1933 United Kingdom .

*Primary Examiner*—Huyen D. Le
*Attorney, Agent, or Firm*—Fisher, Christen & Sabol

[57] ABSTRACT

A loudspeaker for high frequencies (1) including a vibrating diaphragm (4) connected to a moving electromagnetic coil (3) and involving a central annular part (9) and a peripheral annular part (10) connected together along an annular junction (11). The diaphragm (4) is made from a flexible and elastic material so as to exhibit a defined deformation during the motion of the electromagnetic coil (3), and the annular parts (9, 10) are domed and are connected directly via their free end (13, 14) to a fixed structure of the loudspeaker (1).

10 Claims, 2 Drawing Sheets

LOUDSPEAKER FOR HIGH FREQUENCIES

BACKGROUND OF THE INVENTION

1. Field of the Invention

The present invention relates to a loudspeaker for high frequencies.

2. Background Art

It is known that a loudspeaker includes a sound-generating vibrating diaphragm, said diaphragm being connected for this purpose to a moving electromagnetic coil suspended in the air gap created by the pole pieces of a permanent magnet and supplied with an electric current representative of the sounds to be reproduced.

Although not exclusively, the present invention relates more particularly to a compression-chamber loudspeaker. It is known that, contrary to direct-radiation loudspeakers, compression-chamber loudspeakers do not radiate into the air medium directly, but via an acoustic horn. Such loudspeakers therefore include an acoustic horn, generally removable, and a compression-chamber motor.

In regard to said compression-chamber motor, there are essentially two different embodiments which are known and marketed.

In a first already very old embodiment, the diaphragm of the loudspeaker is made in the form of a rigid spherical cap, often metallic and fixed onto the chassis of said loudspeaker by means of a peripheral flexible suspension. The moving electromagnetic coil is connected to the periphery of said diaphragm, between said diaphragm and said suspension, and, during motion, it displaces said cap as a whole in the manner of an infinitely rigid piston. It will be noted that, by virtue of its flexibility, said suspension has the function of displacing and guiding the moving part of the loudspeaker.

This embodiment has a number of drawbacks, in particular:

- the moving coil must displace the entire mass of the moving part of the loudspeaker, thus limiting the emission of sounds at high frequencies and presupposes in particular the use of heavy and expensive magnets to compensate for this defect;
- for reasons of loudspeaker performance, the materials used must be as light as possible while remaining extremely rigid. Beryllium is for example used to make said diaphragm, this of course increasing the cost of these loudspeakers; and
- it is necessary to provide a phasing piece of extremely complex design and construction, since it is necessary to make the elementary radiation from each part of the surface of the diaphragm converge in phase at the mouth of the horn.

In a second embodiment, corresponding to a compression-chamber tweeter loudspeaker, the diaphragm comprises a rigid central annular part and a likewise rigid peripheral annular part, connected together along an annular junction situated opposite the horn of said loudspeaker. Said annular parts are moreover connected to the chassis of said loudspeaker via elastic suspensions, said elastic suspensions being formed by flexibilizing lines concentric with said annular parts, and generally made in the latter. In this embodiment, the diaphragm also moves in the manner of an extremely rigid piston.

The loudspeaker thus constructed makes it possible in particular:

- to emit sounds at high frequencies;
- to use a simple and inexpensive phasing piece; and
- to develop the sound-generating pressure variation, opposite the electromagnetic coil, this being favorable to the production of high frequencies.

However, this embodiment has the major drawback that the diaphragm, with too small an area, and whose suspension is too rigid, does not allow this loudspeaker to operate above 500 Hz.

BROAD DESCRIPTION OF THE INVENTION

The object of the present invention is to remedy these drawbacks. It relates to a loudspeaker for high frequencies, which for equivalent performance is lighter than the loudspeakers of the state of the art and can be constructed easily and at low cost, while allowing sound waves to be emitted in a very extensive passband, especially at the high frequency end, with improved yield.

For this purpose, according to the invention, the loudspeaker for high frequencies including a vibrating diaphragm comprising a central annular part and a peripheral annular part connected together along an annular junction situated opposite the waveguide of said loudspeaker, said diaphragm being connected in the vicinity of said annular junction to a moving electromagnetic coil suspended in the air gap of the pole pieces of a permanent magnet and supplied with an electric current representative of the sounds to be reproduced, is noteworthy in that said diaphragm is made from a flexible and elastic material so as to exhibit a defined deformation during the motion of said electromagnetic coil, and wherein said annular parts are domed and are connected directly via their free end to a fixed structure of said loudspeaker, the convex side of said annular parts being arranged opposite said waveguide.

Thus, by virtue of the invention, only part of the mass of the diaphragm requires to be driven by the moving coil, since a displacement of the latter causes a progressive deformation of said flexible and elastic annular parts, from said annular junction. Consequently, performance in terms of efficiency and passband are greatly improved. Moreover, the present invention does not require the installation of special suspensions, since they are an integral and inseparable part of the diaphragm.

Within the framework of the present invention, flexible and elastic diaphragm is understood to mean a diaphragm capable of deforming and capable of reverting to its initial position after cessation of the stress which was applied to it.

The loudspeaker according to the invention additionally exhibits a number of other advantages, in particular:

- it can emit sounds at high frequencies, at least up to 16 kHz for certain embodiments;
- it can be constructed, like the associated phasing piece, simply and at low cost, since its structure is of the annular type;
- it exhibits a sizable emissive area for a specified diameter of the coil; and
- the diaphragm can be made from a material, for example a composite material or a polymer with high Young's modulus, which is less expensive than that used in the aforesaid known embodiments, since it is no longer required to be almost infinitely rigid.

It will be noted furthermore that a loudspeaker is already known in which the diaphragm is flexible and elastic and is held at its center. Such a diaphragm is designed in the form of a portion of a torus, the peripheral part of which is connected to the moving coil.

Although it is flexible and self-suspended, such a diaphragm is of an entirely different design to that of the present invention and cannot therefore suggest the construction of the latter. Indeed, in this embodiment known by the name "CSD" ("Centrally Supported Diaphragm", that is to say a diaphragm supported at the center), which was in particular presented in a publication relating to the 98th Convention of the AES ("Audio Engineering Society") from Feb. 25 to 28, 1995 in Paris, numbered 3997(L3) and entitled "Computer Modeling and Design of Compression Drivers Based on a Centrally Supported Diaphragm":

- firstly, if it were attempted to adjoin an annular part external to the moving coil to said "CSD" type diaphragm, with a view to rendering the diaphragm annular, the sound flux developed by this external annular part would not be able to converge on the mouth of the horn in the same time as the sound flux developed by the internal annular part, dooming in this case this enhancement;
- secondly, the horn or waveguide is opposite the concave side of said diaphragm and not the convex side, as in the present invention;
- thirdly, the pressure inlet of the mouth of the horn is not situated directly opposite the moving coil, as in the case of the invention.

It will be noted that, within the framework of the present invention, the doming of said annular parts can take all possible forms, in particular that of a circular arc or that of a half-torus.

In a particularly advantageous embodiment of the invention, at least one of said annular parts is connected to said fixed structure in such a way as to form air blades with respect to said fixed structure.

These air blades create dynamic rigidity and give rise to viscous damping proportional to frequency and make it possible in particular to dynamically reduce the emissive area of the diaphragm as a function of the vibration rate.

Moreover, these air blades push the natural eigenmodes of the diaphragm up toward the high frequencies and prevent the appearance of eigenmodes which distort the generation of the sounds.

In order to heighten the advantageous effects described earlier, said air blades exhibit a thickness decreasing progressively toward the region for fixing the diaphragm to the fixed structure.

According to the envisaged embodiment, said air blades can be formed on one side or on both sides of the diaphragm.

Furthermore, advantageously, at least one of said annular parts is furnished with radial flexibilizing lines uniformly distributed over the periphery of said annular part, thus enabling the flexibility of the diaphragm to be increased.

This flexibility can be increased, according to another embodiment, by making, at least on one of said annular parts, radial slots uniformly distributed over the periphery of said annular part and by closing said slots by means of a flexible and elastic resin.

In a preferred embodiment of the invention, said waveguide is a horn and said diaphragm and said electromagnetic coil constitute a compression-chamber motor.

DETAILED DESCRIPTION OF THE INVENTION

Figure 1:
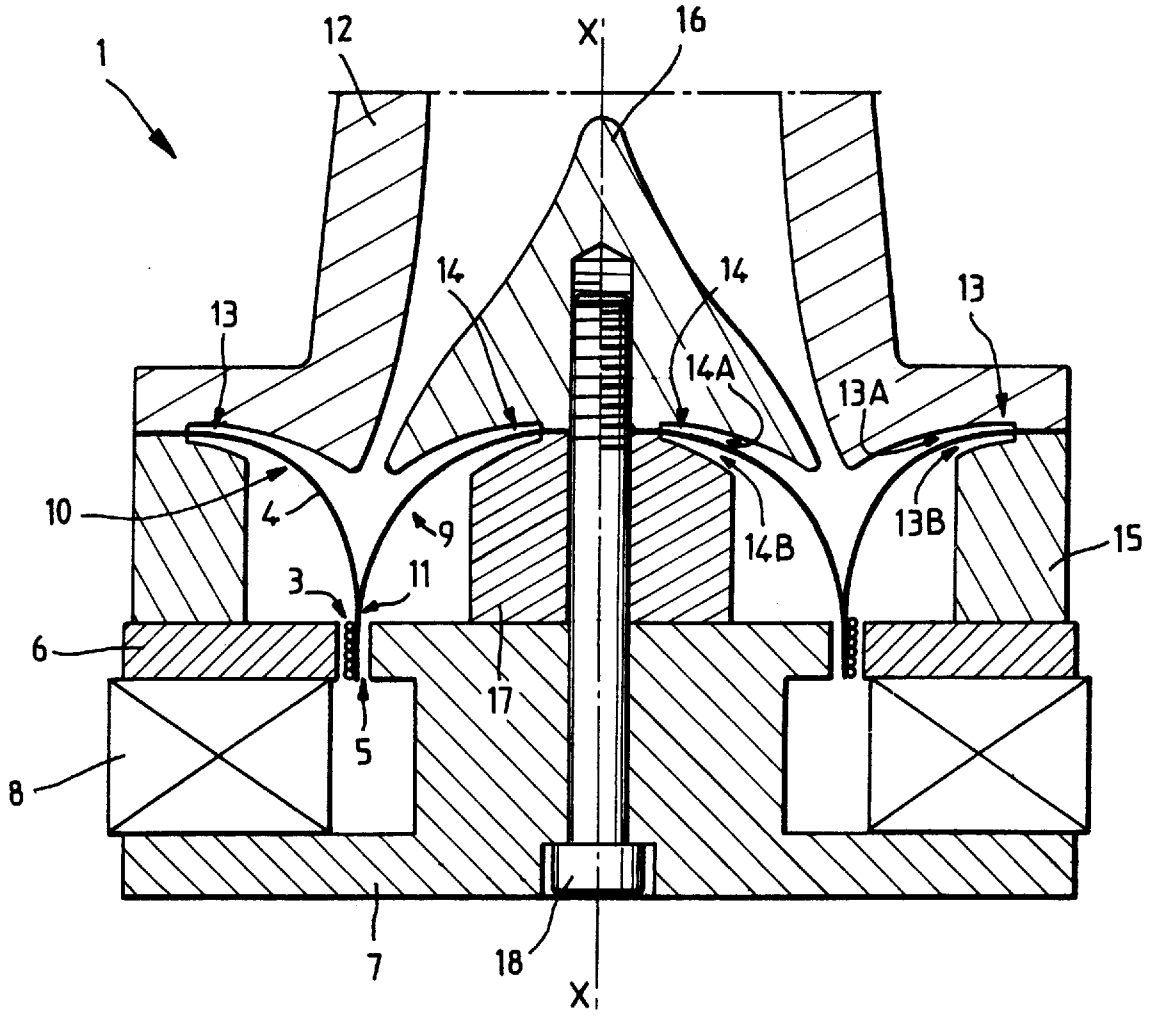
FIG. 1 is a diagrammatic view, in axial section, of a loudspeaker according to the invention.

The appended drawings make clear the manner in which the invention may be embodied.

The loudspeaker for high frequencies 1 according to the invention and represented partially and diagrammatically in the single figure includes, in the usual manner, an electromagnetic coil 3, connected to a monobloc vibrating diaphragm 4, suspended in the air gap 5 of a top plate 6, a pole piece 7 and a permanent magnet 8 and supplied with an electric current representative of the sounds to be reproduced.

The above elements are constructed symmetrically with respect to the axis X—X of said loudspeaker 1.

The diaphragm 4 is of the type comprising a central annular part 9 and a peripheral annular part 10 connected together along an annular junction 11 which is situated opposite a waveguide which, in this case, is represented in the form of a horn 12. Moreover, the coil 3 is connected to said diaphragm 4 in the vicinity of this annular junction 11, directly opposite the mouth of said horn 12.

According to the invention, said diaphragm 4 is made from a flexible and elastic material, which is as light as possible, for example a composite material or a polymer with high Young's modulus, so as to exhibit a defined deformation during motion of the said electro-magnetic coil 3, and said annular parts 10 and 9 are domed and are connected directly by their free end 13 and 14 respectively to a below-specified fixed structure of said loudspeaker 1, the convex side of said annular parts 9 and 10 being situated opposite said horn 12.

It will be noted that a displacement of the coil 3 causes a deformation in the diaphragm 4, which moves from the junction 11 toward the ends 13 and 14 and which gives rise to a variation in the local pressure, generating sound. By virtue of the invention, this variation in the pressure is created near the coil 3 and it is directed in the same sense as the propagation of the deformation in the diaphragm 4, thus making it possible to achieve a high energy yield as far as the conversion of mechanical energy into acoustical energy is concerned.

Moreover, the volume swept by the deformation of the diaphragm 4 can be greater than that swept by a rigid diaphragm of the same size moving in the manner of a piston, as is generally the case for known diaphragms. Thus, in particular, greater sensitivity is conferred on the loudspeaker 1.

Furthermore, by virtue of the present invention, the following advantages are obtained:

- the loudspeaker 1 can emit sounds up to substantially higher frequencies than the loudspeakers of the state of the art;
- it can be constructed simply and at low cost;
- it exhibits a sizable emissive area (in the vicinity of the two flexible annular parts 9 and 10) for a specified diameter of the coil 3; and
- it is of low bulk as it can in particular be constructed with a smaller magnet than in the known embodiments, since the mass to be displaced is less.

It will be noted, furthermore, that within the framework of the present invention, the doming of said annular parts 9 and 10 can take all possible axisymmetric forms, in particular that of a circular arc or that of a half-torus.

Moreover, in order to increase the flexibility of said annular parts 9 and 10, it is possible to make provision, on said annular parts:

- either for radial flexibilizing lines, not represented, uniformly distributed over the periphery of said annular parts;

or for radial slots, not represented, likewise uniformly distributed over the periphery and closed by means of an elastic and flexible resin, for example butyl latex.

The free ends 13 and 14 of said annular parts 10 and 9 are fixed by being built-in between elements of the fixed structure of the loudspeaker 1, namely between said horn 12 and a fixing piece 15 for the end 13 and between a phasing piece 16 and a fixing piece 17 for the end 14.

These elements 12, 15, 16 and 17 are formed in the vicinity of the fixing region in such a way as to create air blades 13A, 13B, 14A and 14B respectively on either side of said ends 13 and 14.

Moreover, said air blades 13A, 13B, 14A and 14B exhibit a thickness decreasing progressively toward the fixing region of the ends 13 and 14, this making it possible to spread the advantageous effects engendered by these air blades and specified below, over the frequency range.

Said air blades in fact exhibit a number of advantages, in particular:

they create dynamic rigidity and give rise to viscous damping;

they make it possible to dynamically reduce the emissive area of the diaphragm as a function of the vibration rate; and they push the natural eigenmodes of the diaphragm up toward the high frequencies.

Of course, within the framework of the present invention, air blades may be provided on only one side of the ends 13 and 14 of the diaphragm 4.

In the case in which, through an air blade defect, there is a risk of the diaphragm 4 touching the fixed structure during its vibration, the relevant region of said structure can advantageously be clad with a suitable impact-damping material so as to prevent the generation of noise liable to disturb the sound emission from the loudspeaker.

It will be noted, furthermore, that by virtue of the invention the phasing piece 16, of conical overall shape, can be constructed in a very simple and inexpensive manner.

As may be seen in the FIG., this phasing piece 16, the fixing piece 17 and the pole piece 7 are connected together by way of a screw 18 with axis X—X passing through a cylindrical drilling made appropriately in these various pieces. Of course, other modes of fixing may be envisaged. The same is true for the unspecified fixing of the other pieces of the loudspeaker 1.

Figure 2:
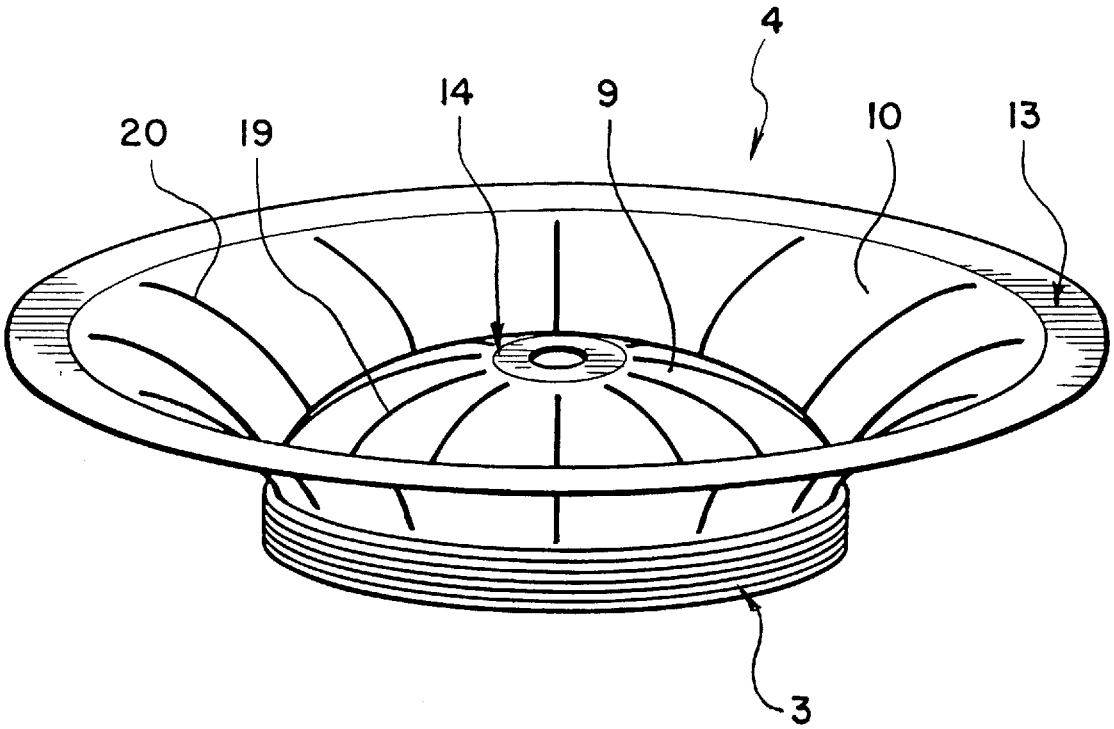
FIG. 2 is a perspective view of the diaphragm, having radial slots, of the invention loudspeaker.

As shown in FIG. 2, radial slots 19 and 20 are located in annular parts 9 and 10, respectively. Radial slots 19 and 20 or radial flexibilizing lines are uniformly distributed over the periphery of such annular parts. Also, annular parts 19 and 20 are closed by means of a flexible, elastic resin (see page 7, lines 28 to 37).

I claim:

1. A high frequency loudspeaker (1) comprising:

a fixed structure;

a unique annular waveguide;

a permanent magnet (8), a top plate (6) and a pole piece (7) defining an air gap (5), said pole piece (7) being nonmovable in relation to said fixed structure, said pole piece (7) having a yoke;

a fixing piece (17) located on top of said yoke (7);

a vibrating diaphragm (4) having a dome-shaped central annular part (9) and a hemidome-shaped peripheral annular part (10) connected together along an annular junction (11) and connected directly via their free ends (13, 14) to said fixed structure of said loudspeaker (1), the convex side of said annular parts (9, 10) being directed towards said waveguide (12), the apex of the convex side of said dome-shaped annular part (9) and the top of said fixing piece (17) being affixed together; and a moving electromagnetic coil (3) connected to said diaphragm (4) in the vicinity of said annular junction (11) and suspended in said air gap (5), said moving electromagnetic coil (3) being supplied with an electric current representative of the sounds to be reproduced, wherein said annular junction (11) is situated opposite said unique waveguide (12); and said vibrating diaphragm (4) is made from a flexible and elastic material so as to exhibit a defined deformation during the motion of said electromagnetic coil, the generated sound wave (SW) having the same propagation direction as the propagation of the deformation (D) in said vibrating diaphragm.

2. The loudspeaker as claimed in claim 1, wherein at least one of said annular parts (9, 10) is connected to said fixed structure in such a way as to form air blades (13A, 13B, 14A, 14B) with respect to said fixed structure.

3. The loudspeaker as claimed in claim 2, wherein said air blades (13A, 13B, 14A, 14B) exhibit a thickness decreasing progressively toward the region for fixing the diaphragm (4) to the fixed structure.

4. The loudspeaker as claimed in claim 2, wherein said air blades are formed on one side of the diaphragm.

5. The loudspeaker as claimed in claim 2, wherein said air blades (13A, 13B, 14A, 14B) are formed on both sides of the diaphragm (4).

6. The loudspeaker as claimed in claim 1, wherein at least one of said annular parts is furnished with radial flexibilizing lines uniformly distributed over the periphery of said annular part.

7. The loudspeaker as claimed in claim 1, wherein at least one of said annular parts is furnished with radial slots uniformly distributed over the periphery of said annular part and closed by means of a flexible and elastic resin.

8. The loudspeaker as claimed in claim 1, wherein said diaphragm (4) is made from a composite material.

9. The loudspeaker as claimed in claim 1, wherein said diaphragm (4) is made from a polymer with high Young's modulus.

10. The loudspeaker as claimed in claim 1, wherein said waveguide (12) is a horn and wherein said diaphragm (4) and said electromagnetic coil (3) constitute a compression-chamber motor.

* * * * *